United States Patent [19]

Birillo

[11] Patent Number: 4,885,665

[45] Date of Patent: Dec. 5, 1989

[54] TRIANGULAR ELECTRIC CEILING FIXTURE

[76] Inventor: Benjamin Birillo, 1045 Fifth Ave., New York, N.Y. 10028

[21] Appl. No.: 294,687

[22] Filed: Jan. 9, 1989

[51] Int. Cl.[4] ..... F21S 1/02

[52] U.S. Cl. ..... 362/147; 362/298; 362/365

[58] Field of Search ..... 362/147, 148, 298, 346, 362/364, 365

[56] References Cited

U.S. PATENT DOCUMENTS

| | | | |
|---|---|---|---|
| 1,955,935 | 4/1934 | Schepmoes | 362/147 |
| 2,998,512 | 8/1961 | Duchene et al. | 362/364 |
| 4,217,629 | 8/1980 | Russell | 362/147 |
| 4,352,151 | 9/1982 | Lewis | 362/147 X |
| 4,713,916 | 12/1987 | Brooks, Jr. | 52/39 |
| 4,731,714 | 3/1988 | Kelly et al. | 362/310 |

*Primary Examiner*—Stephen F. Husar
*Attorney, Agent, or Firm*—Kenyon & Kenyon

[57] ABSTRACT

A triangular electric ceiling fixture comprising a reflector, a lamp housing and a frame. The reflector is open at the bottom and has three flat sides and a peaked roof, two of the reflector sides are rectangular while the third side wall is pentagonal having a top edge that extends from the top edge of the first two rectangular sides upward to an apex in the center of the third side wall. The cylindrical lamp housing is in the form of a cup having a flared lip that is attached to an opening in the third side wall of the reflector with expandable fasteners. A lamp socket is mounted in the base of the housing, allowing only the end of a lamp secured in the socket to extend slightly into the reflector through the opening in the third side wall. The frame is attached to the base or bottom of the reflector. The fixture is particularly adapted to be mounted in a corner of a ceiling, and the configuration of the reflector, along with the position of the lamp, directs substantially glare-free and shadow-free light against the walls of the corner.

13 Claims, 8 Drawing Sheets

TRIANGULAR ELECTRIC CEILING FIXTURE

BACKGROUND OF THE INVENTION

The invention relates generally to electric ceiling fixtures and more particularly to a generally triangularly shaped electric ceiling fixture that is mounted in a corner of a ceiling.

The present invention fulfills a need for an electric ceiling fixtures that is easily mounted in a corner of a ceiling and reflects light in a substantially glare-free and shadow-free manner.

SUMMARY OF THE INVENTION

It is an object of the invention to provide an electric ceiling lighting fixture which is easily mounted in a corner of a ceiling.

It is a further object of the invention to provide an electric ceiling lighting fixture which reflects virtually glare-free and shadow-free light against the walls of the corner of a room.

In accordance with the present invention, these objects are accomplished by provision of a ceiling fixture comprising a frame having means for mounting to a corner of a ceiling, a generally triangular shaped reflector attached to the frame, with the reflector having a peaked roof, an open bottom and three substantially flat side walls with the first and second side walls forming a right angle therebetween and the third side wall connected to said first and second side walls to form a right triangle at the open bottom of the reflector, a lamp housing connected to an opening in the third side wall and extending outwardly therefrom and an electrical socket mounted in the lamp housing and having means for receiving a lamp such that when a lamp is mounted in the electrical socket only the end of the lamp extends into the reflector whereby, upon installation of a lamp into the electrical socket and connection of the socket to a source of electricity, light is reflected from the ceiling fixture in a substantially glare-free and shadow-free manner.

The frame may also be triangular in shape such that it surrounds the open bottom of the reflector and facilitates mounting in the corner of a ceiling. The frame is provided with a finished surface which is visible when the fixture is mounted in the ceiling. The fixture may be mounted to the ceiling by upstanding tabs provided on the frame which are bent downwardly to engage the edge of the ceiling material. The first and second side walls of the generally triangular shaped reflector may be rectangles while the third side wall may be a pentagon. The uppermost point of the pentagon forms the apex of the peaked roof which extends from the top edge of each of the rectangular side walls to the apex. The lamp housing is cylindrical in shape and has an open end provided with an annular flared lip that attaches to the third side wall of the reflector via expandable fasteners.

Another embodiment is disclosed in which the frame is attached to the reflector and mounted to the ceiling by pivotable tabs attached to the frame.

The foregoing objects of the invention along with other objects, aspects and advantages of the present invention will be apparent from the detailed description and claims that follow.

DETAILED DESCRIPTION

Figure 1:
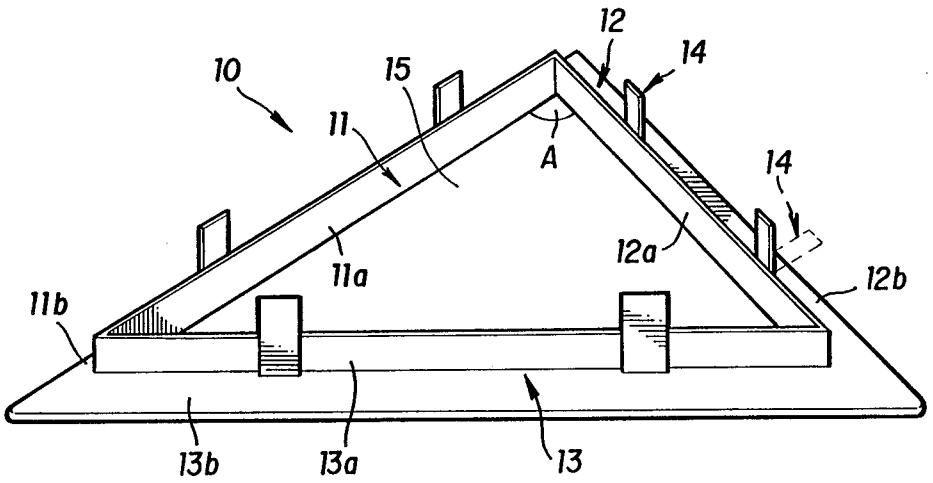
FIG. 1 is a top perspective view of the frame of a triangular electric ceiling fixture constructed according to the principles of the invention.
Figure 2:
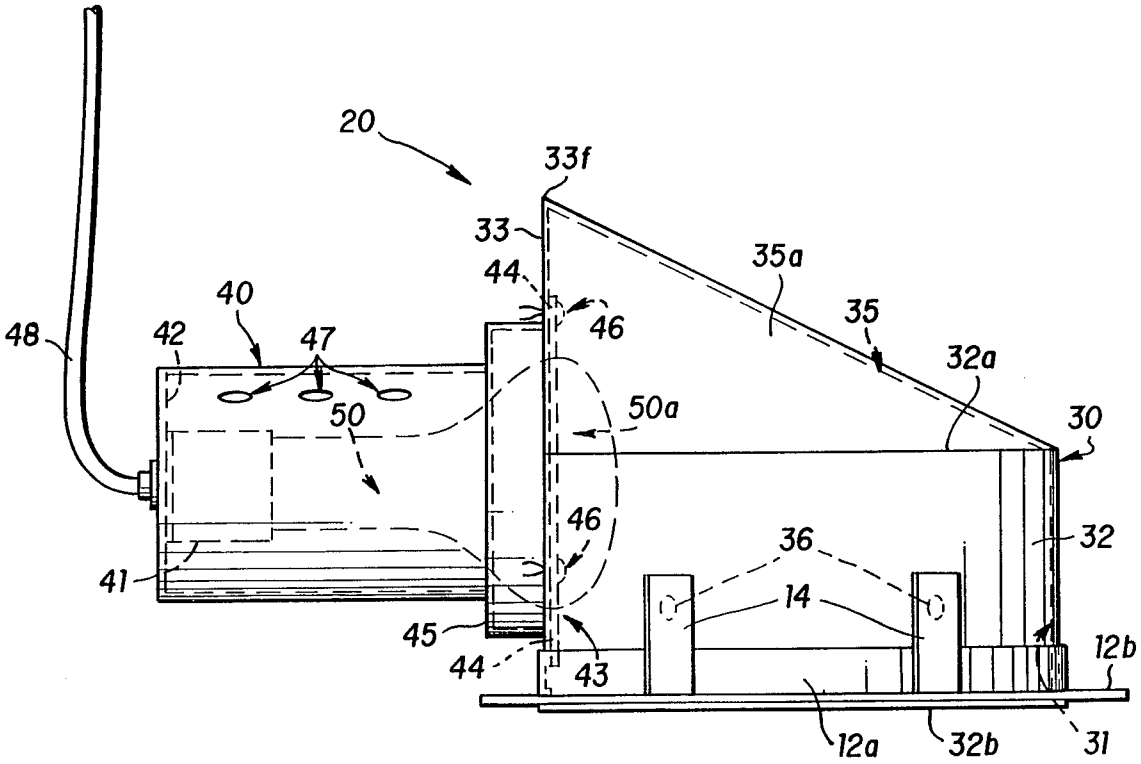
FIG. 2 is a side view of the triangular electric ceiling fixture showing the reflector mounted to the frame and the lamp cylinder attached to the reflector.
Figure 3:
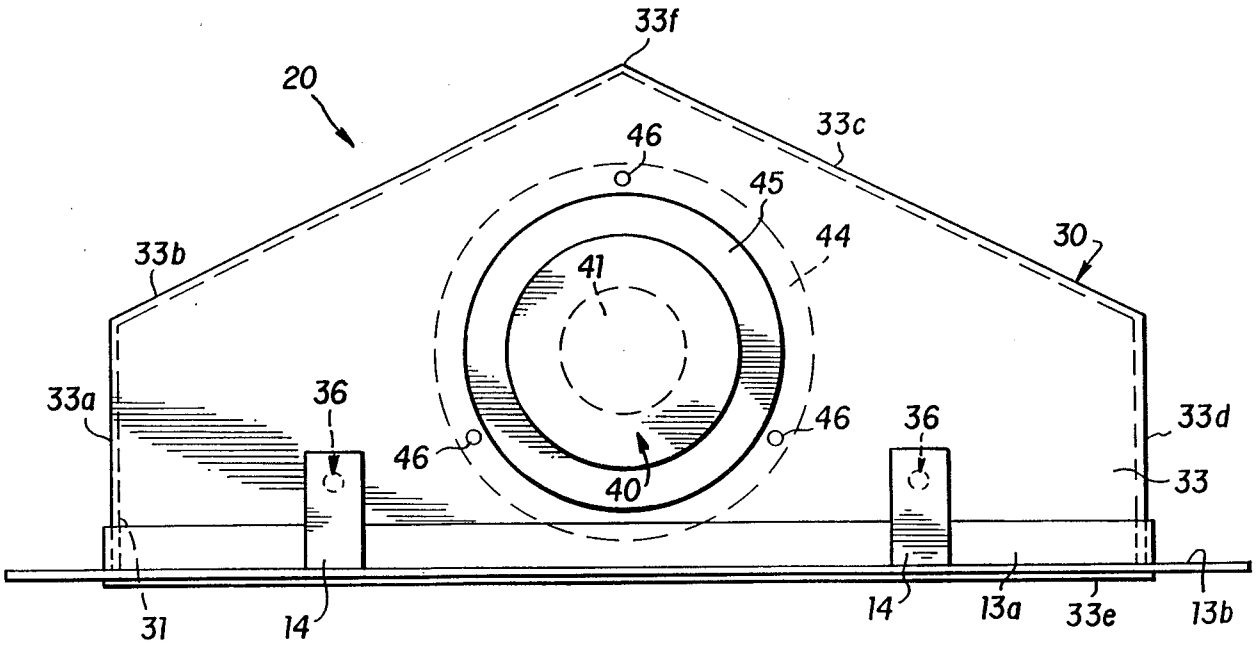
FIG. 3 is an end view of the triangular electrical ceiling fixture showing the pentagonal shape of the third side wall of the reflector.
Figure 4:
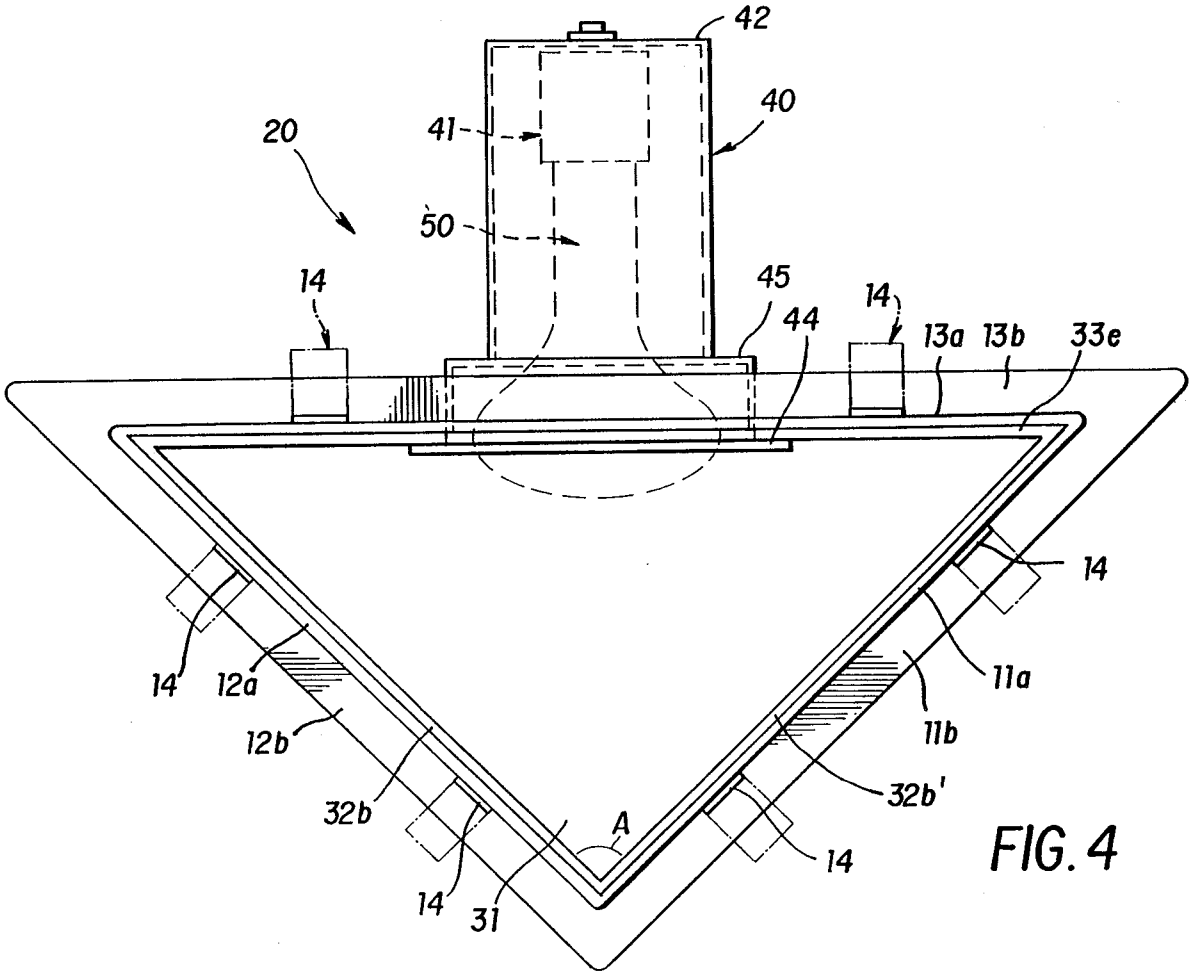
FIG. 4 is a bottom view of the triangular electrical ceiling fixture showing the right triangular frame surrounding the open bottom of the reflector.

FIG. 1 illustrates a frame 10 of a triangular electric ceiling fixture 20 shown in FIGS. 2-4. Frame 10 is attached to a reflector 30 and is provided with upstanding bendable tabs 14 which form means for mounting the triangular electric ceiling fixture to a ceiling. Frame 10 comprises three leg portions 11, 12 and 13. Each leg portion comprises an upstanding vertical lip 11*a*, 12*a*, 13*a* and a flat outwardly extending flange 11*b*, 12*b*, 13*b*. The underneath surfaces of flanges 11*b*, 12*b* and 13*b* are provided with a finished surface which is visible when the fixture is mounted. Legs 11 and 12 are connected to form an angle A which is preferably selected to correspond with the angle made by walls of the corner in which a fixture is to be mounted. In most instances, angle A should be a right angle, i.e., 90°, to facilitate mounting in the typical 90° corner found in most ceilings. Leg 13 is connected at one end to leg 12 and at the other end to leg 11 to form a right triangular shaped opening 15 when A is equal to 90°. The reflector 30 is mounted within opening 15 in a manner subsequently discussed. Legs 11 and 12 may be of equal size such that frame 10 forms an isosceles right triangle. Frame 10 may form other shapes, such as rectangular or square, as long as angle A is selected to conform to the angle of the walls forming the corner in which the ceiling fixture is mounted. Tabs 14 can be bent from inside the wall of the reflector around the edge of the ceiling to fasten the ceiling fixture to the ceiling. As discussed in more detail subsequently, holes 36 (FIGS. 2 and 3) are formed at locations in the reflector aligned with tabs 14 to provide access to the tabs from inside the reflector to bend the tabs around the edge of the ceiling material. In FIG. 1 and FIG. 4, the tabs 14 shown in dashed lines represent the final position after the tabs are downwardly deflected to engage the ceiling material.

As shown in FIGS. 2–4, the open bottom 31 of the reflector 30 is fitted inside upstanding lip portions 11*a*, 12*a* and 13*a* and attached to the frame, by means of spot welds or screws (not shown) or any other convenient means, to support the reflector. Leg portions 11*a*, 12*a* and 13*a* form a right triangular shape defining central opening 15 which surrounds the right triangular open base or bottom 31 of the reflector.

FIG. 2 illustrates a side view of the triangular electric ceiling fixture. The nature of the reflector can best be seen with reference to FIGS. 2–4. The open bottom or base 31 of the reflector provides access to the interior of the reflector and lamp housing 40. The reflector is formed with three substantially flat side walls 32, 32′, 33 and a peaked roof 35. The side walls 32, 32′ are rectangular in shape with only one rectangular side wall 32 being illustrated in FIG. 2. The two rectangular side walls 32, 32′ may be selected to be of equal length to define with third side wall 33 an isosceles right triangular shape for the opening of bottom 31. In this manner, the base of the reflector corresponds to and fits inside the isosceles right triangle formed by frame legs 11*a*, 12*a* and 13*a* as previously discussed. The third side wall 33 of the reflector is a pentagon as indicated by the end view shown in FIG. 3. The pentagonal shape of side wall 33 is formed by side wall edges 33*a*, 33*d*, top edges 33*b*, 33*c*, which rise to apex 33*f*, and bottom edge 33*e*. Rectangular side wall 32 is connected to pentagonal side wall 33 at edge 33*d* while the other rectangular side wall 32′ is connected to pentagonal side wall 33 at 33*a*. The other ends of the rectanglar side walls 32, 32′ are connected to each other (as shown in FIG. 4 illustrating the bottom rectangular side wall edges 32*b*, 32*b*′) at an angle equal to the value of angle A shown in FIG. 1, which, as previously mentioned, is preferably selected to be 90° so as to facilitate mounting in most ceiling corners.

The reflector has a peaked roof 35 formed from two identical triangular sections 35*a*, 35*b* (with only section 35*a* being shown in the drawings). Triangular roof sections 35*a*, 35*b* are identical in size when side walls 32, 32′ are identical and extend from the top edge 32*a*, 32*a*′ of the respective rectangular side wall 32, 32′ to the apex 33*f* at the center of pentagonal side wall 33.

The interior surfaces of the reflector may have a shiny metallic surface or may be painted with a white enamel finish, or may be finished with any other suitable material which provides a shiny or glossy finish suitable for reflection of light.

Attached to pentagonal side wall 33 is a lamp cylinder or housing 40 which contains an electrical socket 41 mounted to the closed end or base 42 in the interior of housing 40. Socket 41 may be a standard LEVITON 1-½ inch diameter socket or other suitable electric socket. The cylindrical lamp housing 40 is cup-shaped with an open end 43 having an annular flared attachment lip 44 which extends radially outwardly from annular flange 45 of housing 40. Housing 40 is inserted from inside the reflector through an opening in pentagonal side wall 33, and flared lip 43 is attached to side wall 33 by expandable fasteners 46. The outline of the flared attachment lip 44 is illustrated in dashed lines in FIG. 3. Lamp housing 40 is provided with a plurality of vent holes 47. Preferably six vent holes are provided in the top of lamp cylinder 40 although only three are visible in the drawings. In FIG. 2 a lamp 50 is shown in dashed lines (along with socket 41) secured in position in electric socket 41. Wire 48 is connected to socket 41 at one end and at the other end to a source of electricity. It is important that socket 41 be mounted within the lamp housing such that when lamp 50 is secured in socket 41, only the end 50*a* of the lamp extends through open end 43 of the lamp housing into the reflector. In this manner, when the ceiling fixture is installed in a corner of a ceiling as subsequently described, light is reflected from the ceiling fixture in a substantially glare-free and shadow-free manner.

As previously mentioned, the reflector 30 is affixed to the frame by spot welding or other suitable means. Holes 36 shown in dashed lines in FIGS. 2–3 are provided in reflector sidewalls 32, 32′, and 33 to facilitate the bending of tabs 14 around the edge of the ceiling material for attachment to the ceiling. The holes 36 allow a tool to be inserted therethrough via open base 31 to pass from the interior of the reflector to depress tabs 14 around the edge of the ceiling material.

FIGS. 5–8 illustrate another embodiment of a triangular electric ceiling fixture constructed according to the principles of the invention in which pivotable tabs 61 are provided to both attach the frame to the reflector and mount the fixture to the ceiling. Only the parts which differ from the embodiment of FIGS. 1–4 are illustrated in FIGS. 5–8.

Figure 5:
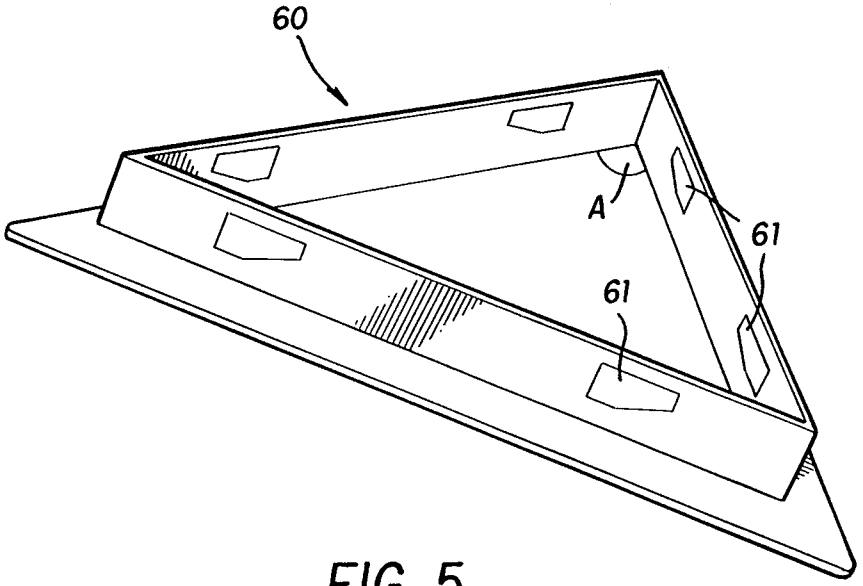
FIG. 5 is a top perspective view of the frame of a second embodiment of a triangular electric ceiling fixture constructed according to the principles of the invention.
Figure 6:
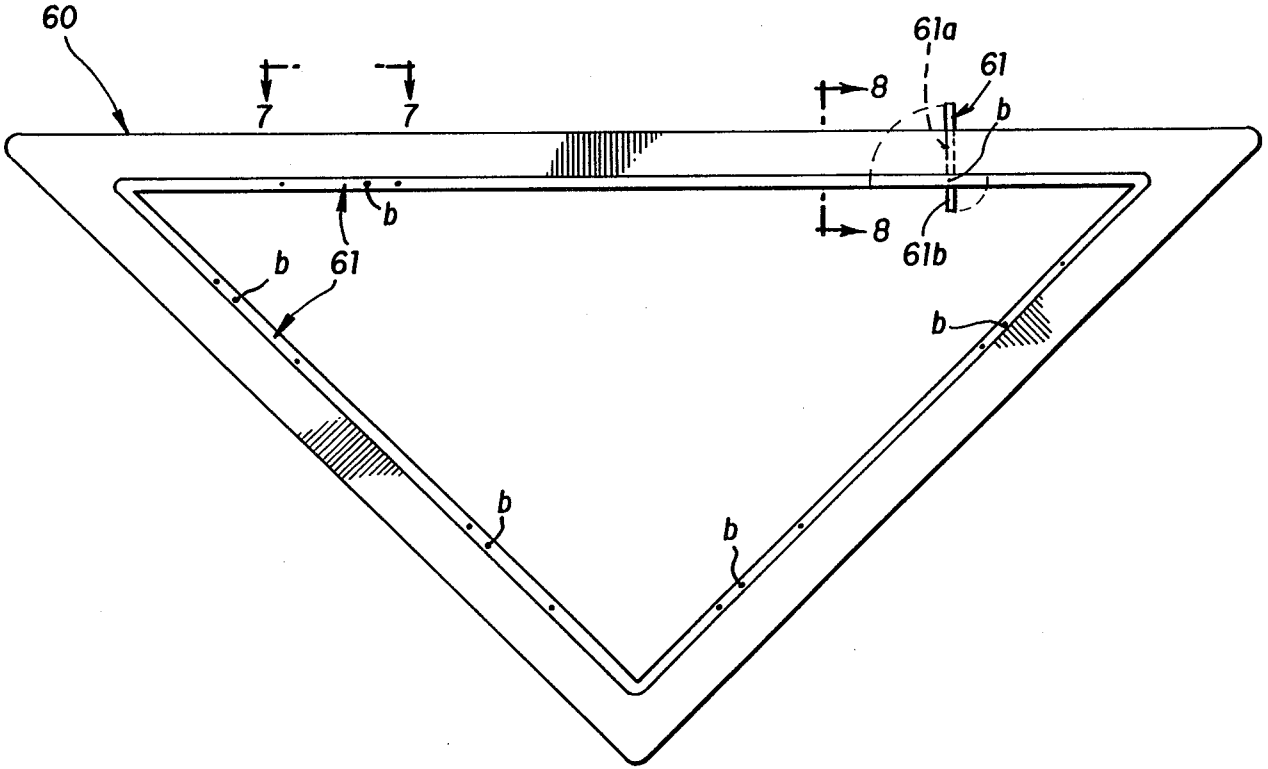
FIG. 6 is a bottom view of the frame illustrated in FIG. 5 showing the locking position of one of the pivotable tabs.

FIG. 5 is a top perspective view of a frame 60 provided with pivotable tabs 61. Each upstanding vertical lip of frame 60 is provided with at least one pivotable tab 61. FIG. 6 illustrates the final position of pivotable tab 61 after it has been pivoted to engage the ceiling material and connect the frame to the reflector. The pivotable tab 61 pivots about an axis b which defines a first tab portion 61*b* which pivots inwardly and a second tab portion 61*a* which pivots outwardly.

Figure 7:
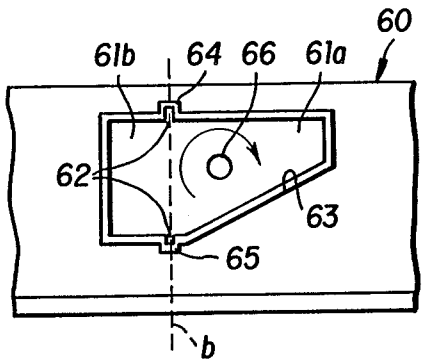
FIG. 7 is a side view of the frame taken along lines 7—7 of FIG. 6 showing the initial position of the pivotable tabs.

FIG. 7 illustrates a partial side view of frame 60 showing a pivotable tab 61 in its initial position. As shown in FIG. 7, pivotable tab 61 is received in a correspondingly shaped aperture 63 and mounted for pivotable movement therein about axis b by pin member 62. The ends of pin member 62 are received in recesses 64 and 65 formed in aperture 63. Pin member 62 may comprise a separate member inserted through a bore in pivotable tab 61 having a longitudinal axis coincident with pivot axis b. Alternatively, pin member 62 may comprise outwardly extending projections integrally formed with pivotable tab 61. Tab portion 61*a* contains a hole 66 which cooperates with a disposable, rotatable key member 67 (FIG. 8) forming means for pivoting the pivotable tabs.

Figure 8:
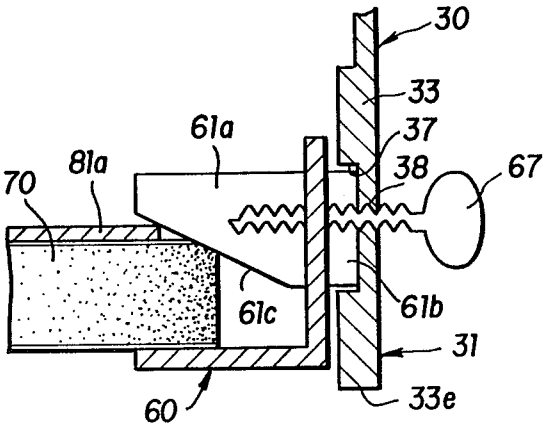
FIG. 8 is a cross sectional view taken along lines 8—8 of FIG. 6 in connection with an adjacent portion of the reflector and an adjacent ceiling portion, showing the locking cooperation between the pivotable tab, reflector and ceiling.

FIG. 8 illustrates a sectional view through lines 8—8 of FIG. 6 and additionally shows the open ended bottom 31 of reflector 30 and an adjacent portion of a ceiling 70 (not shown in FIG. 6). FIG. 8 shows the final position of pivotable tabs 61 and reflector side wall 33. It is understood that FIG. 8 is representative of the pivotable tab connection of the other reflector sides to the frame and ceiling. In order to attach frame 60 to reflector 30 and mount the fixture in the ceiling to ceiling material 70, rotatable key member 67 is inserted through the open ended bottom 31 of the reflector. Key 67 is threaded through hole 38 in side wall 33. Hole 38 opens into a recess 37 formed on the outside of reflector side wall 33 that is adapted to receive one or more tab portions 61b to attach the reflector 30 to frame 60. Tab portion 61a is provided with a sloped bottom edge 61c adapted to frictionally engage ceiling material 70 between the tab edge 61c and the outwardly extending flange of frame 60 for mounting the fixture to the ceiling. Hole 66 in tab portion 61a is aligned with hole 38. Upon rotation of key member 67 through holes 38 and 66, pivotable tab 61 is caused to rotate about pivot axis b such that tab portion 61b is received in recess 37 and sloped surface 61c of tab portion 61a frictionally engages ceiling material 70. After tab portion 61a is sufficiently frictionally engaged with ceiling material 70, the rotatable key member 67 is unscrewed from holes 66 and 38. Tab member 61 remains in its final locked position due to the frictional force developed between sloped surface 61c and ceiling material 70. The key may then be disposed and hole 38 plugged by a suitable plug member (not shown). Edge 61c is sloped so as to accommodate mounting in ceilings of varying thickness.

In another embodiment (not illustrated) the pivotable tabs may comprise portions of the upstanding vertical lips of the frame that are stamped out in the general configuration of tab portion 61a. In this manner, tab portion 61a can be bent in a hinge like manner about axis b to engage the ceiling material. In this embodiment, the frame is attached to the reflector by spot welding or other suitable means.

Figure 10:
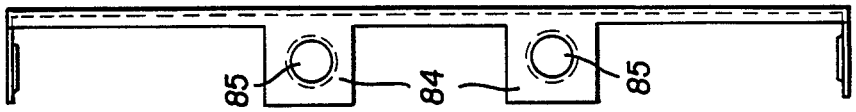
FIG. 10 is a side view of the ceiling mounting frame illustrated in FIG. 9 showing mounting flanges for connection to the mounting bar.
Figure 9:
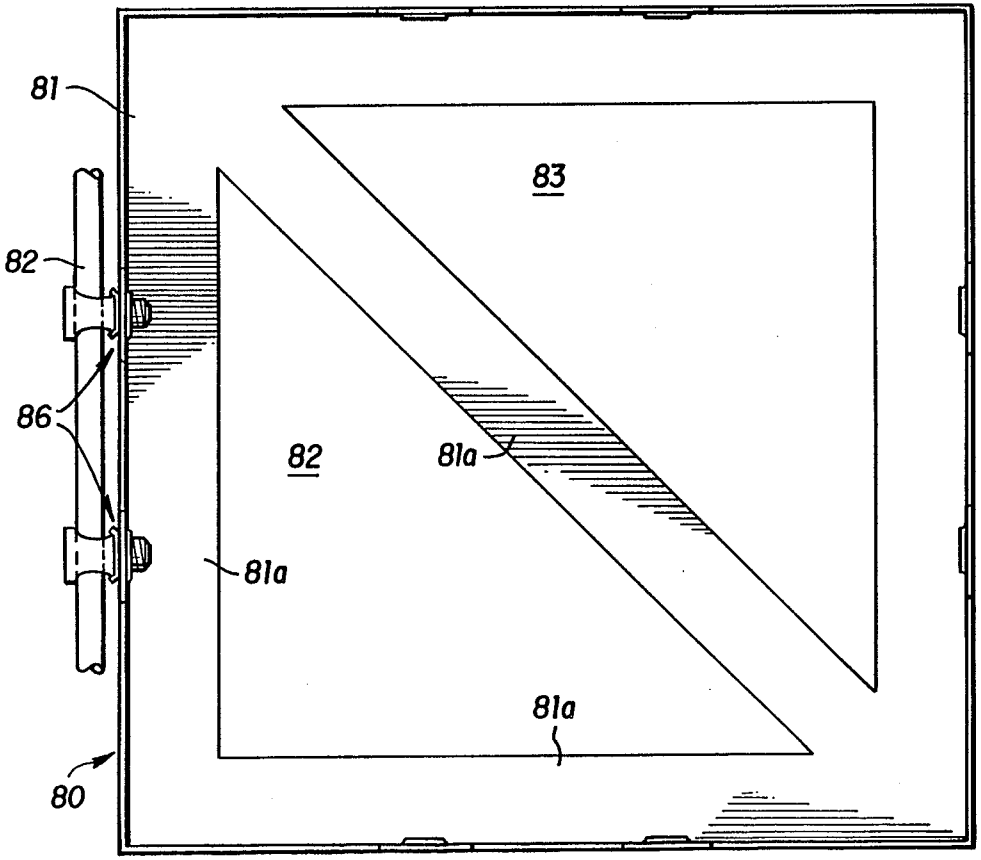
FIG. 9 is a top plan view of a ceiling mounting frame and mounting bar used to connect the triangular electric ceiling fixture of the invention to supporting structure in the ceiling.

The ceiling fixture may be further attached to a supporting structure in the ceiling by means of a connection from the supporting structure to the reflector 30. One such connection is illustrated in FIGS. 9 and 10, but forms no part of the invention described herein. Such connections often are required by local municipal codes. The ceiling mounting connection 80 shown in FIG. 9 comprises a square-shaped mounting frame 81 and a mounting bar 82 which has mounting flanges at each end that connect to the ceiling structure to support frame 81. The mounting flanges are not shown. Mounting frame 81 contains two holes 82 and 83 that are triangular in shape and are dimensioned to allow the triangular electric ceiling fixture, including its triangular mounting frame 60. The connection shown in FIGS. 9 and 10 is described in connection with the embodiment of FIGS. 5–8, but it is recognized that a similar type connection could be employed with the other embodiments described herein. Only one of the triangular openings 82 or 83 is used at a time. From the side view shown in FIG. 10, the flanges 84 and the screw holes 85 are illustrated. The mounting bar 82 is attached to mounting frame 81 by means of a screw connection 86 which attaches to screw holes 85 of mounting flanges 84 in a manner well known in the art. As shown in FIG. 9, a plurality of mounting flanges 84 are provided about the periphery of frame 81 and extend upwardly out of the plane of the paper in the view shown in FIG. 9. The mounting flanges 84 and screw holes 85 are shown in FIG. 10 and may be formed as flair stamped holes.

FIG. 8 illustrates how the triangular electric ceiling fixture of the embodiment shown in FIGS. 5–8 is supported in mounting frame 81. As can be seen from the cross-sectional view of FIG. 8, the inner portion 81a of mounting frame 81 rests against second tab portion 61a of pivotal tab 61. Thus, the ceiling material 70 is sandwiched between mounting frame portion 81a and the top surface of the bottom part of triangular frame 60. In this manner, should a ceiling material 70, such as plasterboard, deteriorate, the triangular electric ceiling fixture remains supported by mounting frame portions 81a which are firmly connected to the ceiling structure by mounting bar 82. Mounting bar 82 and mounting frame 81 are typically formed from metal.

What is claimed is

1. A ceiling fixture for mounting in a corner of a ceiling, the fixture comprising:

a frame having means for mounting within a corresponding opening at a corner of a ceiling;

a generally triangular shaped reflector attached to said frame, said reflector having a peaked roof, an open bottom and three substantially flat side walls with the first and second side walls forming a right angle therebetween and the third side wall connected to said first and second side walls to form a right triangle at the open bottom of the reflector;

a lamp housing connected to an opening in said third side wall and extending outwardly therefrom; and an electrical socket mounted in said lamp housing and having means for receiving a lamp such that when a lamp is mounted in the electrical socket only the end of the lamp extends into the reflector whereby, upon installation of a lamp into the electrical socket and connection of the socket to a source of electricity, light is reflected from the ceiling fixture in a substantially glare-free and shadow-free manner.

2. A ceiling fixture according to claim 1 wherein said first and second side walls of the reflector are rectangular in shape, said third side wall of the reflector is pentagonal in shape and the peaked roof extends from a top edge of each of said first and second rectangular side walls to an apex of said third pentagonal side wall.

3. A ceiling fixture according to claim 2 wherein said frame is generally triangular in shape and comprises three leg portions connected to form a right triangular opening therebetween, said right triangular opening surrounding the open bottom of the reflector.

4. A ceiling fixture according to claim 3 wherein said means for mounting within a corresponding opening at a corner of a ceiling comprises bendable tabs attached to said frame.

5. A ceiling fixture according to claim 4 wherein said side walls of the reflector are formed with holes aligned with said bendable tabs, said holes allowing deflection of said bendable tabs from inside the reflector.

6. A ceiling fixture according to claim 5 wherein each of the leg portions of the frame comprises an upstanding vertical lip and a flat outwardly extending flange with at least one of said bendable tabs attached to each leg portion of the frame.

7. A ceiling fixture according to claim 1 wherein said lamp housing comprises a cylinder having a closed end and an open end and said electrical socket is mounted to the closed end of the cylinder.

8. A ceiling fixture according to claim 7 wherein said open end of the lamp housing comprises an annular flange having a radially outwardly extending annular flared lip connected to said third side wall by a plurality of expandable fasteners.

9. A ceiling fixture according to claim 3 wherein said means for mounting within a corresponding opening at a corner of a ceiling comprises pivotable tabs attached to said frame.

10. A ceiling fixture according to claim 9 wherein each of the leg portions of the frame comprises an upstanding vertical lip and a flat outwardly extending flange with at least one pivotable tab attached to each leg portion of the frame.

11. A ceiling fixture according to claim 10 further comprising means for pivoting said pivotable tabs and wherein each of said pivotable tabs comprises: a pin member defining a pivot axis; a first tab portion disposed on one side of said pivot axis; and a second tab portion disposed on the other side of said pivot axis, with each upstanding vertical lip defining at least one aperture in which one of said pivotable tabs is mounted for pivotable movement.

12. A ceiling fixture according to claim 11 wherein said means for mounting within a corresponding opening at a corner of a ceiling further comprises:

a recess formed in an outer portion of each of said reflector side walls for receiving said first tab portion to attach said frame to said reflector; and an edge of said second tab portion being engageable with ceiling material adjacent to the opening.

13. A ceiling fixture according to claim 12 wherein said means for pivoting said pivotable tabs comprises a disposable key member threaded through a first opening in said recess and a second opening in the second tab portion wherein rotation of said key member pivots said first tab portion inwardly into said recess and said second tab portion outwardly to frictionally engage said ceiling material.

* * * * *